US005166486A

United States Patent [19]

Komatsu et al.

[11] Patent Number: 5,166,486

[45] Date of Patent: Nov. 24, 1992

[54] TURNTABLE SUPPORT FOR HEATING COOKING APPLIANCES

[75] Inventors: Morimasa Komatsu, Ichinomiya; Toshio Arakawa; Keizo Shimeno, both of Nagoya, all of Japan

[73] Assignee: Kabushiki Kaisha Toshiba, Kanagawa, Japan

[21] Appl. No.: 595,384

[22] Filed: Oct. 10, 1990

[30] Foreign Application Priority Data

| | | | |
|---|---|---|---|
| Oct. 25, 1989 | [JP] | Japan | 1-124969 |
| Nov. 25, 1989 | [JP] | Japan | 1-305823 |
| Dec. 27, 1989 | [JP] | Japan | 1-339028 |

[51] Int. Cl.[5] ..... H05B 6/78

[52] U.S. Cl. ..... 219/10.55 F; 219/10.55 E

[58] Field of Search ..... 219/10.55 F, 10.55 E; 99/421 R, 421 HV; 366/219

[56] References Cited

U.S. PATENT DOCUMENTS

| | | | |
|---|---|---|---|
| 4,501,945 | 2/1985 | Arabori et al. | 219/10.55 F |
| 4,631,379 | 12/1986 | Aoyama | 219/10.55 F |
| 4,742,202 | 5/1988 | Campbell et al. | 219/10.55 F |

*Primary Examiner*—Philip H. Leung

*Attorney, Agent, or Firm*—Philip M. Shaw, Jr.

[57] ABSTRACT

A microwave oven includes a casing defining a heating chamber, a track member disposed in the heating chamber and having an undulate surface circumferentially extended, an electric motor mounted in the casing, a plurality of rolling members each moved along the undulate surface of the track member by the motor, rolling about respective axes thereof in contact with the undulate surface of the track member, and a turntable on which food to be cooked is placed, the turntable having a traveling face and placed on the rolling members so that the traveling face thereof is in contact with the rolling members, whereby the turntable is rotated with a vertical movement.

4 Claims, 6 Drawing Sheets

TURNTABLE SUPPORT FOR HEATING COOKING APPLIANCES

BACKGROUND OF THE INVENTION

This invention relates to a heating cooking appliance which includes a casing defining a heating chamber in which food is cooked by means of high frequency waves, high-temperature gas or radiant heat, and more particularly to such a heating cooking appliance wherein a turntable on which the food to be cooked is placed is rotatable with vertical movement.

Japanese Published Utility Model Application No. 52-12993 and Japanese Laid-open Patent Application No. 52-3743, for example, each disclose a high frequency heating apparatus comprising a casing defining a heating chamber in which food is cooked and a magnetron generating high frequency waves or microwaves delivered into the heating chamber and a turntable on which the food to be cooked is placed and which is disposed in the heating chamber so as to be rotated by drive means with a vertical movement. Since the turntable and therefore, the food placed thereon is moved in the directions of three dimensions in the heating chamber in such a high frequency heating apparatus, the food can be uniformly exposed to the microwaves and accordingly, a uniform heating effect may be expected over the food. More specifically, it is expected that an unevenness in the heating against the food in the horizontal direction can be overcome by the rotation of the turntable and further that the unevenness in the heating in the direction of the thickness of the food can be overcome by the vertical movement of the turntable. In a turntable drive mechanism employed in the conventional high frequency heating apparatus, upon rotation of the turntable, a plurality of rollers mounted on shafts secured to the turntable are moved along an undulate surface formed on a track member secured in the heating chamber. However, in the above-described construction, the turntable is rotated with the vertical movement such that a portion of the food placed on the turntable always passes certain, fixed upper and lower limit spatial points. Consequently, the portion of the food placed on the turntable is continuously exposed to the high or low density of microwaves, which prevents the dissolution of the unevenness in the heating in the direction of the thickness of the food.

SUMMARY OF THE INVENTION

Therefore, a primary object of the present invention is to provide an improved heating cooking appliance wherein the upper and lower limit spatial points which a portion of the food placed on the turntable passes are varied in the course of rotation of the turntable with the vertical movement.

Another object of the invention is to provide an improved heating cooking appliance wherein a user can be prevented from being given an impression that the turntable being actually rotated in the horizontal direction has stopped.

Further another object of the invention is to provide an improved heating cooking appliance wherein smooth vertical movement of the turntable can be expected.

The heating cooking appliance in accordance with the invention comprises a casing defining a heating chamber, a track member disposed in the heating chamber and having an undulate surface circumferentially extended, drive means provided in the casing, a plurality of rolling members each moved along the undulate surface of the track member by the drive means, rotating about respective axes thereof in contact with the undulate surface of the track member, and a turntable on which food to be cooked is placed, the turntable having a traveling face and placed on the rolling members so that the traveling face thereof is in contact with the rolling members, whereby the turntable is horizontally rotated with a vertical movement.

In accordance with the above-described appliance, the rolling members are moved along the undulate surface of the track member with rotation about the respective axes caused by the contact thereof with the undulate surface. The movement of the rolling members is transmitted to the turntable, which is rotated. Where La represents the distance that a point on the turntable is circumferentially moved and Lb represents the distance that each rolling member is moved in the horizontal direction, La is shown by the expression, $La=2Lb+\alpha$. In the expression the symbol $\alpha$ represents the difference between Lb and the circumferential length Lb' of the undulate surface of the distance Lb. Consequently, each of the upper and lower limit points which a portion of the food placed on the turntable passes with the rotation of the turntable is circumferentially shifted by $\lambda$ in turn in the course of rotation thereof, which enhances the prevention of occurrence of unevenness in the heating in the direction of the thickness of the food.

The invention may also be practiced by the heating cooking appliance comprising a casing defining a heating chamber, a fixed member disposed in the heating chamber and having a traveling face circumferentially extended, drive means provided in the casing, a plurality of rolling members moved along the traveling face by the drive means, rotating about respective axes in contact with the traveling face of the fixed member, and a turntable on which food to be cooked is placed, the turntable having an undulate surface circumferentially extended, the turntable being placed on the rolling members so that the undulate surface thereof is in contact with the rolling members, whereby the turntable is rotated with the vertical movement.

It is preferable that the undulate surface of the track member have a plurality of inclined sections raising the turntable and a plurality of inclined sections lowering the turntable and an inclination of each inclined section raising the turntable have a value larger than an inclination of each inclined section lowering the turntable.

It is further preferable that the drive means comprise a plurality of arms laterally extended and rotatably moved about respective axes, the arms having one ends on which the rolling members are movably mounted, respectively, and each arm have an articulated portion at a suitable position thereof so as to be vertically bent at the articulated portion.

Other objects of the present invention will become obvious upon understanding of an illustrative embodiment about to be described or will be indicated in the appended claims. Various advantages not referred to herein will occur to one skilled in the art upon employment of the invention in practice.

DESCRIPTION OF THE PREFERRED EMBODIMENT

Figure 1:
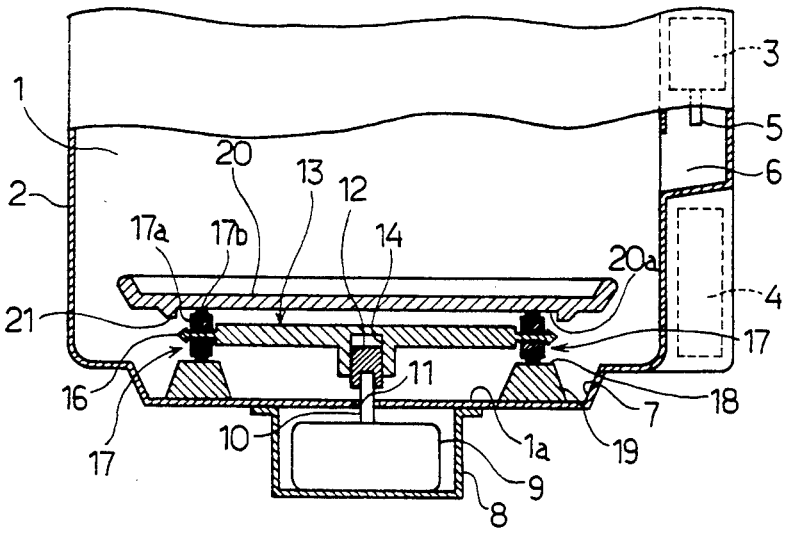
FIG. 1 is a longitudinal sectional view of the major portion of a high frequency heating apparatus of an embodiment of the invention.

A first embodiment of the invention will be described with reference to FIGS. 1 to 3 of the drawings. A heating cooking apparatus of the first embodiment comprises a casing 2 defining a heating chamber 1 therein. A magnetron 3 and control circuit 4 for controlling the magnetron 3 are provided in the casing 2, as well known in the art. Upon drive of the magnetron 3, high frequency waves are propagated from an antenna 5 and radiated into the heating chamber 1 through a waveguide 6 formed in the casing 2 so as to be communicated with the interior of the heating chamber 1. A generally circular recessed portion 7 is formed in the bottom of the heating chamber 1. An electric motor 9 serving as drive means is mounted on the underside of the circular recessed portion 7 by a supporting frame 8. A shaft 10 of the motor 9 is extended into the interior of the heating chamber 2 through an aperture 11 formed in the recessed portion 7. A rectangular coupling member 12 is attached to the upper end of the motor shaft 10.

A rotational member 13 has a generally rectangular engagement recess 14 formed in the central underside thereof. The engagement recess 14 is engaged with the coupling member 12 for a vertically slidable movement. The rotational member 13 further has three arms 15 each radially (or transversely) extended from the central portion thereof with an angle of 120°. Shafts 16 are projected from one ends of the arms 15, respectively. Three rollers 17 serving as rolling members are rotatably mounted on the shafts 16, respectively. Each roller 17 comprises a base 17*a* and a ring 17*b* formed of a material having a large friction coefficient such as rubber, the ring 17*b* being fitted with the periphery of the base 17*a*. The rotational member 13 is disposed on the bottom of the heating chamber 1 in the state that the engagement recess 14 thereof is engaged with the coupling member 12 so that the rotational member 13 is rotated by the motor 9. In this regard, the rollers 17 are placed on a circular track member or ring member 19 having an undulate surface 18 formed thereon so as to be circumferentially extended. The undulate surface 18 has a plurality of inclined sections raising a turntable 20 and a plurality of inclined sections lowering the turntable 20, which turntable 20 will be described below. The undulate surface 18 is formed so as to have one cycle of concave and convex portions at the angle of 120°. The ring member 19 is secured to the circular recessed portion 7 so as to be concentric with the shaft 10 of the motor 9.

The turntable 20 is formed into the shape of a flat dish and has a flat face or traveling face 20*a* on the underside. The turntable 20 has on the underside circumferential edge thereof an annular stopper 21 projected downwardly. The radius of the annular stopper 21 is determined to be slightly larger than the radius of a locus of each roller 17 when the rotational member 13 is rotated. The turntable 20 is placed on the rollers 17 of the rotational member 13 so as to be approximately concentric with the rotational member 13 with the stopper 21 positioned outside the rollers 17.

Figure 3:
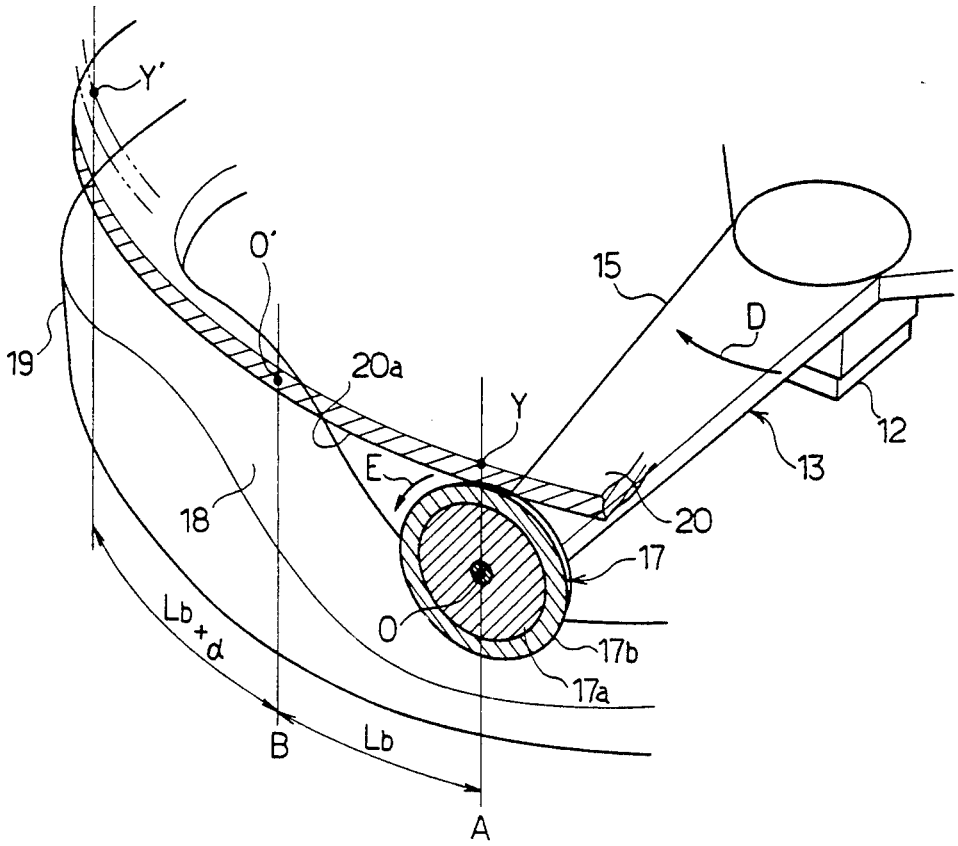
FIG. 3 is a partial perspective view of the turntable drive device for explaining the operation thereof.

In operation, the motor 9 is driven at a constant speed in the cooking operation such that the rotational member 13 is rotated at a constant speed, for example, in the direction of an arrow D in FIG. 3. With rotation of the rotational member 13, each roller 17 rolls along the undulate surface 18 of the ring member 19 or rotates about its shaft 16 in the direction of an arrow E and simultaneously, is moved in the direction of an arrow D in FIG. 3. The rotation and movement of each roller 17 rotate the turntable 20. Since each roller 17 is vertically moved along the undulate surface 18, the turntable 20 is also vertically moved. When the rotation and movement of each roller 17 rotate the turntable 20, it is rotated at a speed higher than and in the same direction as the rotational member 13. More specifically, assume now that one point on the rotational member 13, for example, the center O of one of the rollers 17 is moved from a position A to another position B when the rotational member 13 is rotated, as shown in FIG. 3. The symbol O′ represents the position of the center O after rotation of the rotational member 13. Take a symbol Lb as the distance that the roller center O of the rotational member 13 is moved from the position A to the position B. Furthermore, take a symbol Y as a point on the turntable 20 corresponding to the roller center O and a symbol Y′ represents a position of the point Y after the rotational member 13 is moved till the roller center O occupies the point O′. When the rotational member 13 is rotated by the horizontal distance Lb from the position A to the position B, each roller 17 rolls along the undulate surface 18 during rotation of the rotational member 13, and the distance that each roller 17 rolls may be represented by a symbol Lb when the surface along which the roller rolls is a horizontal plane. However, since the surface along which the rollers 17 roll is undulate, the actual distance that each roller 17 rolls is slightly longer than the distance Lb (for example, by the distance $\alpha$). Accordingly, the distance that the point Y on the turntable 20 is moved with rotation thereof is represented by $La=2Lb+\alpha$. Consequently, the upper and lower limit positions which the portion Y passes are circumferentially shifted by the distance $\alpha$ in turn with the rotation of the turntable 20 in the horizontal direction, which enhances the prevention of occurrence of the unevenness in the heating in the direction of the thickness of the food placed on the turntable.

Figure 2:
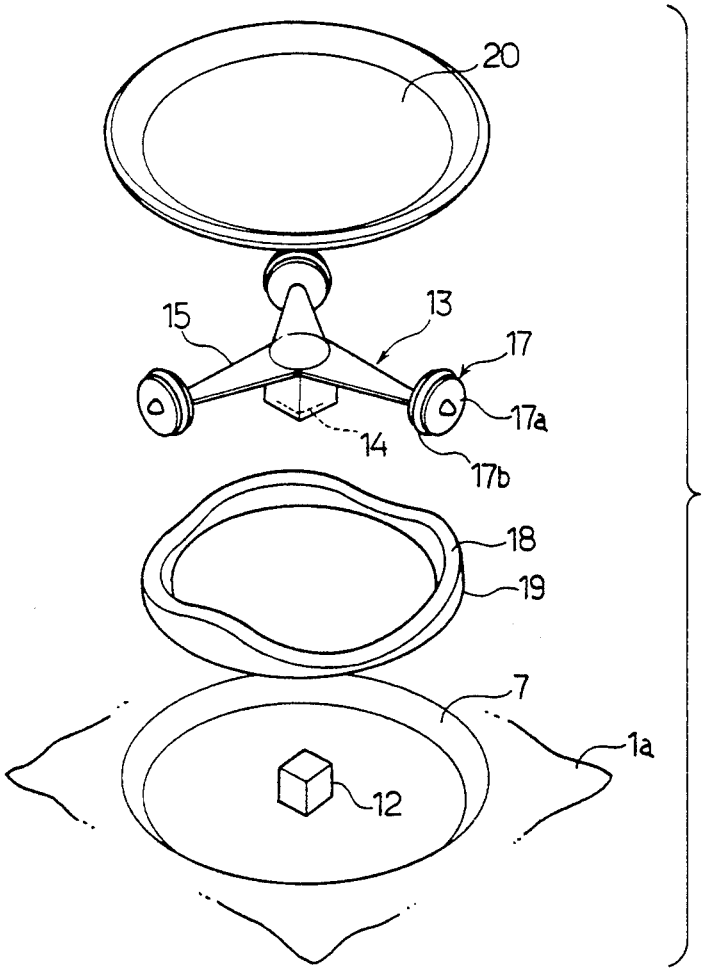
FIG. 2 is an exploded perspective view of a turntable drive device in the apparatus shown in FIG. 1.
Figure 4:
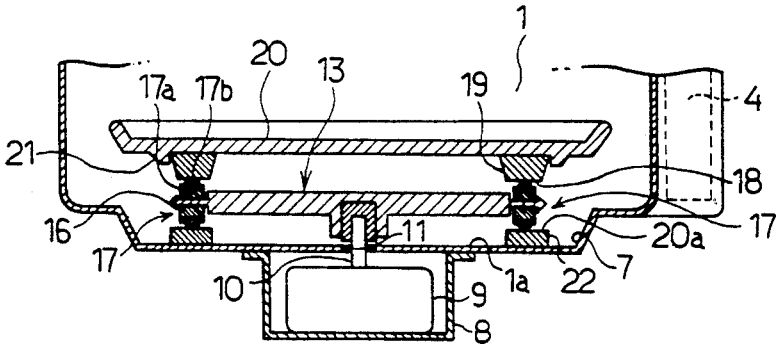
FIG. 4 is a view similar to FIG. 1 showing a modified form of the high frequency heating apparatus in FIG. 1.

The above-described construction may be modified as shown in FIG. 4 in which identical parts are labeled by the same reference numeral as in FIG. 1. That is, the member 19 having the undulate surface 18 is provided on the underside of the turntable 20. The member 22 having the flat face 20*a* is secured on the bottom 1*a* of the heating chamber 1.

Figure 5:
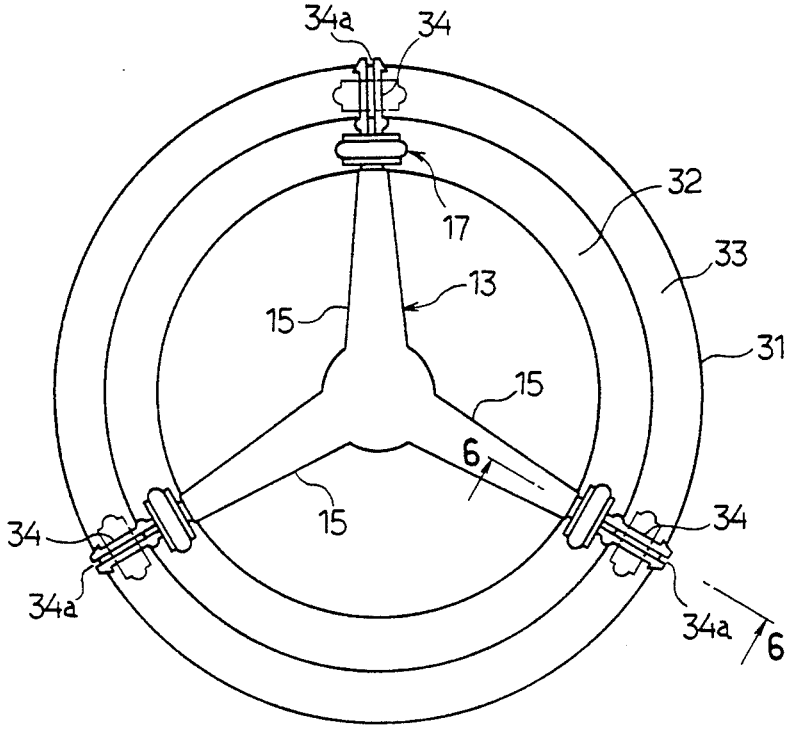
FIG. 5 is a plan view of a turntable drive device of the high frequency heating apparatus of a second embodiment.
Figure 6:
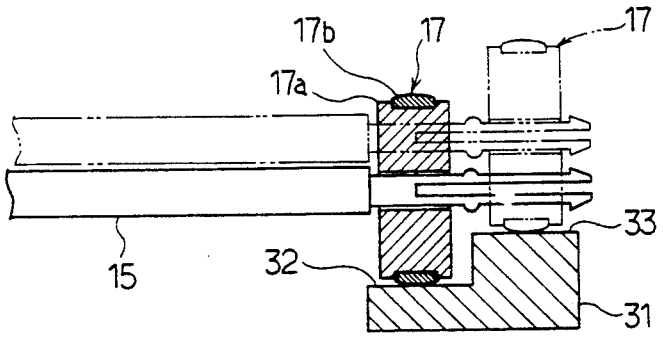
FIG. 6 is an enlarged longitudinal section taken along line 6—6 in FIG. 5.
Figure 7:
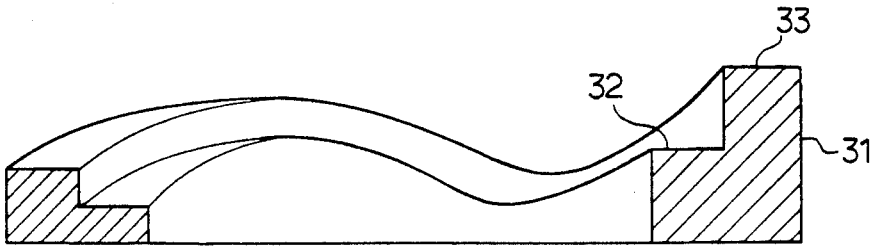
FIG. 7 is an enlarged longitudinal section of a ring member shown in FIG. 5.

A second embodiment of the invention will now be described with reference to FIGS. 5 to 7. The ring member 31 has a two-staged configuration, that is, undulate surfaces 32, 33 having both the height and the amplitude different from each other are formed at the inside and outside of the ring member 31, respectively. A slit-like groove 34*a* is formed in the shaft 34 of each rotational member 13 so that each roller 17 is selectively mounted on either an inner receiving position as shown by a solid line in FIGS. 5 and 6 or an outer receiving position as shown by an alternate long and two short dashes line. In accordance with this embodiment, the vertical position and the vertical movement amplitude of the turntable 20 may be varied and the position thereof during rotation may also be varied. As a result, a suitable cooking manner may be provided in accordance with kinds and amount of food to be cooked.

Figure 8:
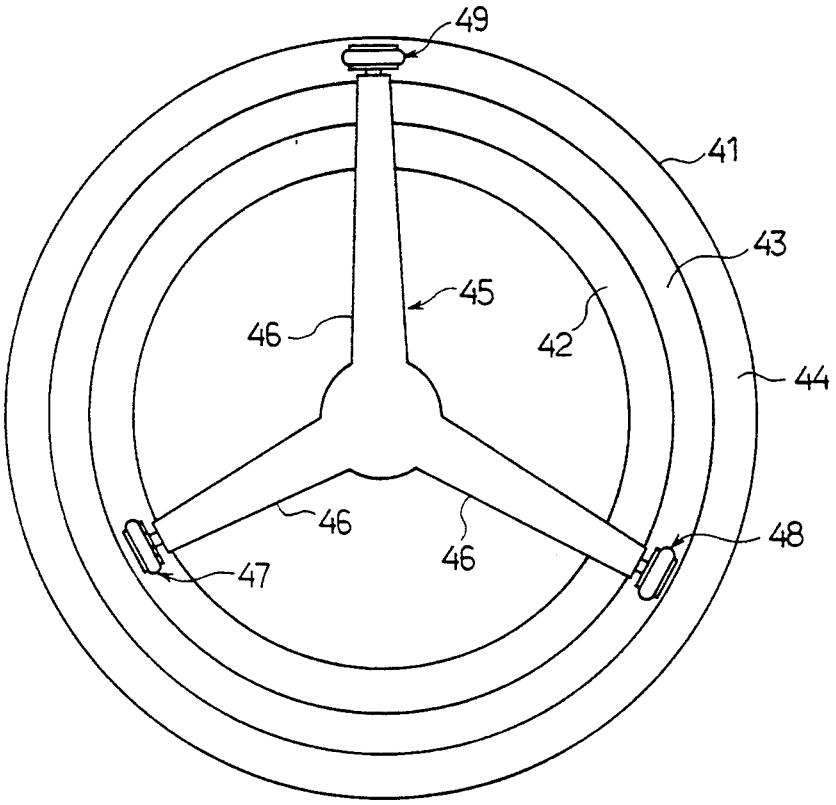
FIG. 8 is a view similar to FIG. 5 showing the turntable drive device of the high frequency heating apparatus of a third embodiment.
Figure 9:
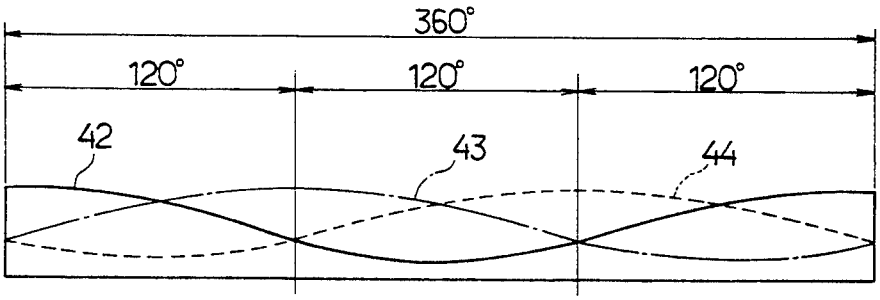
FIG. 9 is a view explaining the phase relationship among three undulate portions of the ring members.

FIGS. 8 and 9 illustrate a third embodiment of the invention. The third embodiment differs from the first embodiment in the following points. Three undulate surfaces 42, 43 and 44 are formed on the ring member 41 so as to be concentric with and have different radius values from one another. Each undulate surface 42, 43, 44 is formed so as to have one cycle of concave and convex during one rotation of the rotational member 45. Phases of the undulate surfaces 42, 43 and 44 are deviated from one another by 120°. The distances between the center of the rotational member 45 and each roller 47, 48, 49 differ from one another and are determined to correspond with the radius of the undulate surfaces 47, 48 and 49 of the ring member 41, respectively. Accordingly, upon rotation of the rotational member 45, the rollers 47, 48 and 49 are vertically moved, held at the same height and the turntable 20 vertically reciprocates once while rotated twice. At least three rollers need to be disposed at intervals of 120° so that the turntable is maintained in the horizontal state. In the arrangement shown in FIG. 2 wherein three rollers are moved on the same radius, the completion of one cycle of undulate surface needs a section of 120°. However, this arrangement increases the inclination of the undulate surface, which increases a load torque of the motor 9. On the other hand, in the arrangement shown in FIG. 8, since one cycle of the undulate surface covers the section of 360°, the inclination of each of the undulate surfaces 42–44 is reduced, resulting in the decrease in the load torque against the motor 9.

Figure 10:
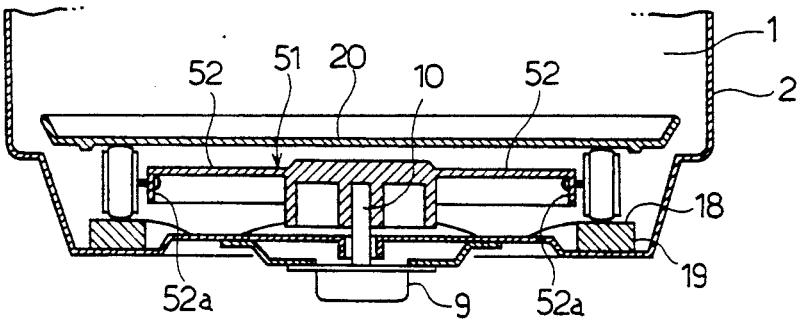
FIG. 10 is a view similar to FIG. 1 showing the high frequency heating apparatus of a fourth embodiment.
Figure 11:
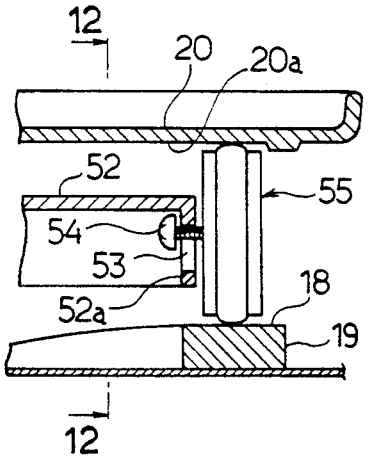
FIG. 11 is an enlarged view of one roller and its peripheral portion.
Figure 12:
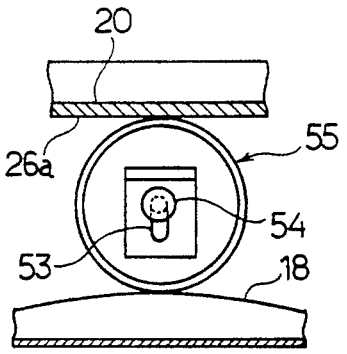
FIG. 12 is a longitudinal section taken along line 12—12 in FIG. 11.

FIGS. 10 to 12 illustrate a fourth embodiment. The fourth embodiment differs from the first embodiment in the following point. The rotational member 51 having arms 52 is coupled to the rotational shaft 10 of the motor 9 so as not to be vertically moved. A vertical wall portion 52*a* is formed on the distal end of each arm 52 of the rotational member 51. Each vertical wall portion 52*a* has a hole 53 vertically elongated. Each roller 55 is mounted on each shaft support member 54 disposed in each hole 53 for the vertical sliding movement. In the embodiment, when the rotational member 51 is rotated, the rollers 55 are moved vertically. Accordingly, assuming that the rotational member 51 is coupled to the rotational shaft of the motor for the vertical movement, a smooth vertical sliding movement of the rotational member 51 relative to the motor shaft 10 tends to be prevented by the effect of inclination of the rotational member 51 caused by the undulate surface 18 through the rollers 55 and consequently, the smooth rotation of the arms 52 is prevented. However, the arrangement of the fourth embodiment eliminates such a failure.

Figure 13:
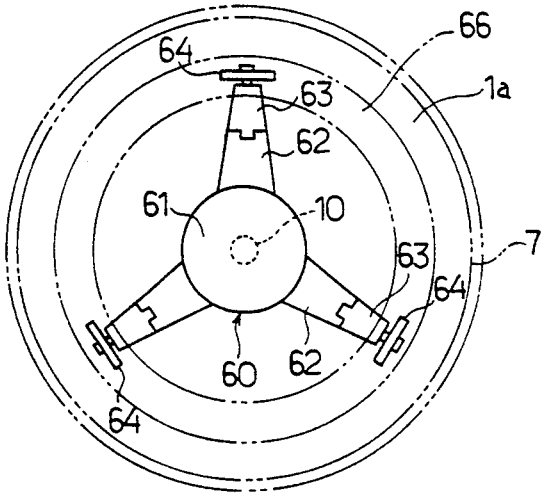
FIG. 13 is a plan view of the turntable drive device in the high frequency heating apparatus of a fifth embodiment.
Figure 14:
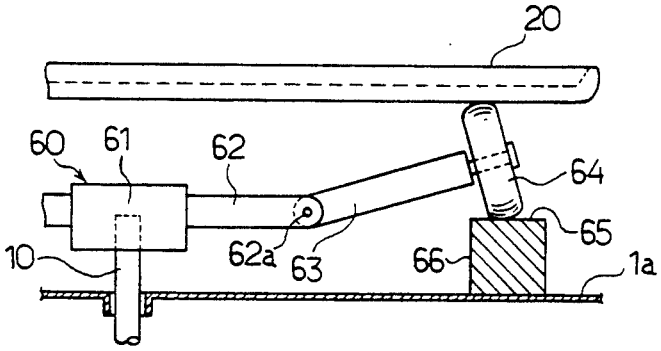
FIG. 14 is an enlarged longitudinal section of the major portion of the device in FIG. 13.
Figure 15:
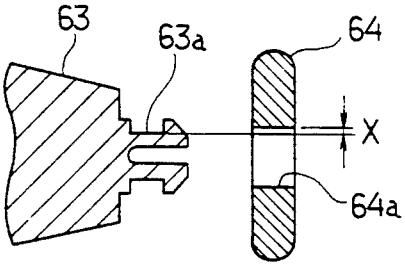
FIG. 15 is an enlarged exploded perspective view of the roller supporting portion in FIG. 14.

A fifth embodiment will be described with reference to FIGS. 13 to 16. In these figures, same parts are labeled by the identical numerals as those in FIGS. 1 to 3. A boss 61 of a roller support member 60 composing the drive means is secured to the upper portion of the shaft 10 of the motor 9 so as to be rotated with the shaft. A plurality of arm pieces 62 composing the respective arms are radially extended from the outer periphery of the boss 61 of the roller support member 60. Three such arm pieces are shown in FIG. 13. One ends of another arm pieces 63 are coupled with the distal ends of the arm pieces 62 by pins 62*a* respectively so as to be vertically bendable such that the articulated portions are provided. Furthermore, rollers 64 each having a generally arced peripheral surface are mounted on the shaft portions 63*a* formed on the other ends of the arm pieces 63, respectively. As shown in FIG. 15, the outer diameter of shaft portions 63*a* of the arm pieces 63 which are inserted into bearing holes 64*a* of the rollers 64, respectively, is slightly smaller than the inner diameter of the bearing holes 64*a* in consideration of production, assembly and cost. Consequently, the dimensional difference between the shaft portions 63*a* and the respective bearing holes 64*a* or a gap X is provided. A ring member 66 having an undulate surface 65 along which the rollers 64 roll is disposed on the bottom of the heating chamber 1 in the same manner as shown in FIG. 1.

Figure 16:
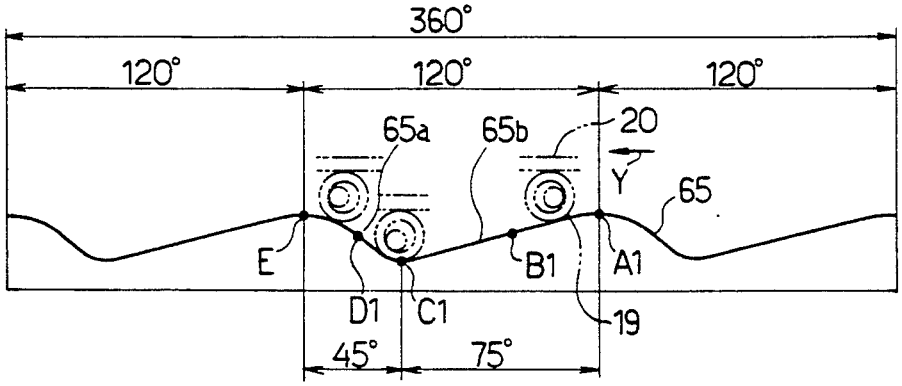
FIG. 16 is a view for explaining the configuration of the undulate surface shown in FIG. 14.

The undulate surface 65 is formed so that the turntable 20 vertically reciprocates once every time each arm comprising the arm pieces 62, 63 is rotated 120°. As shown in FIG. 16 in particular, a mean inclination of the section 65*a* of the undulate surface 65 raising the turntable 20 or the section from point C1 to E through D1 is larger than a mean inclination of the section 65*b* of the undulate surface 65 lowering the turntable 20 or the section from A1 to C1 through B1. In this regard, the surface sections 65*a* and 65*b* are set so that the section 65*a* occupies the region of 45° in 120° and the section 65*b* occupies the region of 75°.

When drive of the motor 9 rotates the motor shaft 10 causes the roller support member 60 in the horizontal direction, each roller 64 rolls along the undulate surface 65 of the ring member 66, which causes each roller 64 to roll along the undulate surface 65 of the ring member 66. Consequently, turntable 20 is rotated in the horizontal direction with vertical movement. Since each arm piece 63 is vertically bent about the pin 62*a* against the other arm piece 62 while each roller 64 is being vertically moved along the undulate surface 65, the boss 61 of the roller support member 60 need not vertically slide relative to the motor shaft 10. Consequently, the same effect as achieved in the embodiment described with reference to FIGS. 10–12 is achieved in this embodiment.

When rolling along the lowering section 65*b* of the undulate surface 65, each roller 64 is subjected to the weight of the turntable 20 within the gap X in FIG. 15 and tends to move in the direction of an arrow A preceding the shaft portion 63*a*. On the other hand, when each roller 64 reaches the section 64*a* raising the turntable 20, each shaft portion 63*a* tends to move preceding the roller 64 within the gap X in the shaft hole 64*a*. The rotation of the turntable 20 is stopped or the inertia causes it to reduce its speed while the shaft portion 63*a* is moving forward in the gap X, which gives an operator an impression that the turntable 20 were in the state of uneven, abnormal rotation. As a result, the operator may mistakenly consider that the turntable is wrong. However, in the present invention, the turntable raising section 64*a* of the undulate surface 65 of the ring member 66 has an inclination larger than the turntable lowering section 65*b* thereof. Consequently, the rotational and raising speed of the turntable 20 is increased in the section 65*a*, which reduces the period of the uneven rotational state of the turntable due to the gap X. As a result, the operator is not given an impression that the turntable 20 were in the uneven, abnormal rotational state and accordingly, there is no possibility that the operator mistakenly considers that the turntable is wrong.

The foregoing disclosure and drawings are merely illustrative of the principles of the present invention and are not to be interpreted in a limiting sense. The only limitation is to be determined from the appended claims.

We claim:

1. A heating cooling appliance comprising:

a) a casing defining a heating chamber;

b) heating means for heating food contained in the heating chamber;

c) a turntable on which food to be cooked is placed;

d) a track member disposed in the heating chamber and having an undulate surface circumferentially extended, the undulate surface of the track member having a plurality of inclined sections raising the turntable and a plurality of inclined sections lowering the turntable, each inclined section raising the turntable having an inclination larger than each inclined section lowering the turntable;

e) drive means provided in the casing; and f) a plurality of rolling members each moved along the undulate surface of the track member by the drive means, and rotating about respective axes thereof in contact with the undulate surface of the track member, the turntable having a traveling face and placed on the rolling members so that the traveling face thereof is in contact with the rolling members, whereby the turntable is horizontally rotated with a vertical movement.

2. A heating cooling appliance according to claim 1, wherein the drive means comprises a plurality of arms laterally extended and rotatably moved about respective vertical axes, the arms having one ends on which the rolling members are movably mounted, respectively, and each arm has an articulated portion at a suitable position thereof so as to be vertically bent at the articulated portion.

3. A heating cooking appliance comprising:

a) a casing defining a heating chamber;

b) heating means for heating food contained in the heating chamber;

c) a fixed member disposed in the heating chamber and having a traveling face circumferentially extended;

d) drive means provided in the casing;

e) a plurality of rolling members each moved along the traveling face of the fixed member by the drive means, rotating about respective axes thereof in contact with the traveling face of the fixed member; and f) a turntable on which food is placed, the turntable having an undulate surface circumferentially extended, the undulate surface of the turntable having a plurality of inclined sections raising the turntable and a plurality of inclined sections lowering the turntable, each inclined section raising the turntable having an inclination larger than each inclined section lowering the turntable, the turntable being placed on the rolling members so that the undulate surface of the turntable is in contact with the rolling members, whereby the turntable is horizontally rotated with vertical movement.

4. A heating cooking appliance according to claim 3, wherein the drive means comprises a plurality of arms laterally extended and rotatably moved about respective vertical axes, the arm having one ends on which the rolling members are movably mounted, respectively, and each the arm has an articulated portion at a suitable position thereof so as to be vertically bent at the articulated portion.

* * * * *